United States Patent [19]

Meredith, Jr.

[11] Patent Number: 4,577,752

[45] Date of Patent: Mar. 25, 1986

[54] HIGH DENSITY TOW BALE AND METHOD FOR FORMING IT

[75] Inventor: Thomas D. Meredith, Jr., Kingsport, Tenn.

[73] Assignee: Eastman Kodak Company, Rochester, N.Y.

[21] Appl. No.: 607,049

[22] Filed: May 4, 1984

[51] Int. Cl.[4] ..... B65D 71/00

[52] U.S. Cl. ..... 206/83.5; 206/388; 206/442

[58] Field of Search ..... 706/388, 417, 442, 83.5

[56] References Cited

U.S. PATENT DOCUMENTS

| | | | |
|---|---|---|---|
| 181,389 | 8/1876 | Archer | 206/83.5 |
| 281,490 | 7/1883 | Grader | 206/83.5 |
| 1,468,130 | 9/1923 | Angier | 206/83.5 |
| 2,127,118 | 8/1938 | Herbelin | 206/83.5 |
| 2,705,557 | 4/1955 | Hartman | 206/83.5 |
| 3,914,918 | 10/1975 | Laird | 206/83.5 |
| 4,320,701 | 3/1982 | Donaldson | 206/83.5 |

FOREIGN PATENT DOCUMENTS

| | | | |
|---|---|---|---|
| 25159 | 3/1907 | New Zealand | 206/442 |

*Primary Examiner*—Joseph Man-Fu Moy

*Attorney, Agent, or Firm*—Malcolm G. Dunn; William P. Heath, Jr.

[57] ABSTRACT

An improved high density tow bale wrapped with a cardboard or the like covering and held in compressed condition by multiple strappings which extend around the bale, the tow bale having on its bottom a pattern of multiple pads for supporting the bale on a floor and unrelieved areas between the pads for receiving the strappings therealong; and the method for forming the improved high density tow bale.

4 Claims, 3 Drawing Figures

HIGH DENSITY TOW BALE AND METHOD FOR FORMING IT

DESCRIPTION

1. Technical Field

My invention relates to an improved high density tow bale, such as a filter tow bale from which cigarette filters are made, and to the method for making the improved high density tow bale.

2. Background Art

When opening a wrapped tow bale in preparation for removing and processing the tow, the operator must cut and remove the multiple metal strappings which extend around the wrapped bale in different directions at right angles with respect to each other. There is usually no difficulty in manually pulling the metal strappings from under the tow bale while the bale is seated on the floor because the bottom of the tow bale presents a somewhat rounded and softer surface to the floor. The strappings usually cut grooves into the covering of the soft surface of the bale upon release of the bale from compression by the tow baler due to a certain amount of spring-back by the bale. However, when opening high density tow bales having almost 25% more weight (such as 816.47 kilograms or about 1800 pounds) than the weight of regular density tow bales, operators have discovered that it is more difficult, if not impossible, to remove the metal strappings from the bottom of the bale. The higher density makes it necessary to use a denser, heavier cardboard cap in order to contain the higher density tow and prevent the metal strappings from cutting through the cardboard covering. The bottoms of high density bales are harder and tend to be flatter and thus provide a greater surface area in contact with the floor so that the metal strappings are pressed and held against the floor by the tow bale. The harder bottom surfaces of the tow bale and the heavier cardboard covering prevent the metal strappings from cutting grooves in the covering of the bale because there is little or no spring-back when the bale is released from compression in a tow baler. It is therefore nearly physically impossible to remove the metal strappings from the tow bale by normal manual effort. Operators having this problem have temporarily solved it by cutting the metal strappings up to the bottom edges of the tow bale. Later, after the tow has been completely withdrawn from the tow bale, cleanup personnel usually pick up by hand the metal strappings that remain under the tow bale. Sometimes the cleanup personnel are injured by the sharp ends of the metal strappings where the strappings had been cut up to the bottom edges of the tow bale.

An object of my invention is to form on the bottom of the tow bale a pattern of multiple pads and unrelieved areas between the pads so that the pads will contact the floor while the tow bale is seated thereon for opening and that the strappings will be received within the unrelieved areas and will thus be out of contact with the floor and as a consequence readily slidably removed from the bottom of the tow bale.

DISCLOSURE OF THE INVENTION

In accordance with the present invention, I provide an improved high density tow bale in which filamentary tow such as filter tow has been compressed and wrapped with a cardboard or the like covering and held in compressed condition by multiple strappings which extend around the wrapped bale in different directions at right angles with respect to each other, the improved high density tow bale being characterized by its bottom having embossed therein a pattern of multiple pads and unrelieved areas between the pads, the unrelieved areas being adapted to receive the strappings and the pads adapted to make contact with the floor while the bale is seated thereon for opening and thereby enable the strappings to be readily slidably removed from the bottom of the bale.

The multiple pads are formed by embossing in both the cardboard or the like covering and the filamentary tow that is adjacent the covering at the bottom of the bale.

I also provide in a bale in which filamentary tow such as filter tow has been compressed by a tow baler and wrapped with a cardboard or the like covering and held in compressed condition by multiple strappings which extend around the wrapped bale in different directions at right angles with respect to each other, the method of forming by embossing on the bottom of the bale a pattern of multiple pads and unrelieved areas between the pads, the unrelieved areas adapted to receive the strappings and the pads adapted to make contact with the floor while the bale is seated thereon for opening and thereby enable the strappings to be readily slidably removed from the bottom of the bale.

In the method, the multiple pads are embossed by the tow baler as the filamentary tow is being compressed by the tow baler, and preferably formed by embossing both the covering and the filamentary tow that is adjacent the covering at the bottom of the bale by the platen of the tow baler as the filamentary tow is being compressed by the tow baler.

The platen of the tow baler may comprise a number of separate sections extending across the face of the platen and slots of predetermined width and depth between the sections, each section of a predetermined number of the separate sections defining within its face a recessed surface, and the method includes the step of pressing the filamentary tow adjacent the bottom covering of the bale and the bottom covering into each of the recessed surfaces to form by embossing the above-mentioned pattern of multiple pads and unrelieved areas between the pads as the filamentary tow is being compressed by the tow baler.

BRIEF DESCRIPTION OF DRAWINGS

The details of my invention will be described in connection with the accompanying drawings, in which.

BEST MODE FOR CARRYING OUT THE INVENTION

Figure 1:
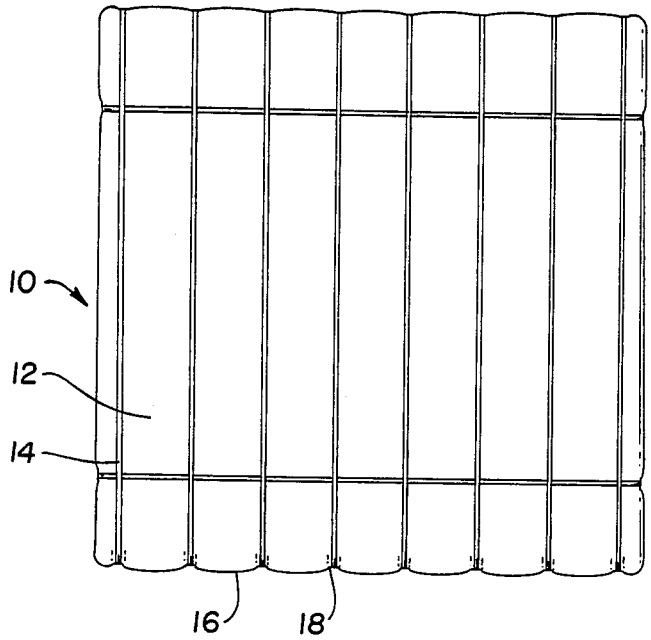
FIG. 1 is an elevational view of my improved high density wrapped tow bale and illustrating at the bottom of the tow bale in exaggerated profile part of the pattern of multiple pads and unrelieved areas between the pads.

A high density tow bale, such as a filter tow bale for cigarette filter tow, is shown in FIG. 1 at 10. The tow bale may be wrapped with a protective covering 12, such as a cardboard or the like covering, and is usually held in compressed condition by multiple strappings 14 which extend around the wrapped bale in different directions at right angles to each other. The strappings are usually made of a metal such as steel. The multiple strappings are installed around the tow bale while the tow bale is held under compression by a tow baler (not shown).

My improved high density tow bale 10 is different from a regular density tow bale in that a pattern of multiple pads 16 and unrelieved areas 18 between the pads have been formed by embossing on the bottom of the high density tow bale. The pads are adapted to make contact with the floor while the bale is seated thereon for opening, and the unrelieved areas are adapted to receive the multiple strappings 14 which are essentially out of contact with the floor. The multiple pads are formed by embossing in both the covering of the bale and the filamentary tow that is adjacent the covering at the bottom of the bale. As previously indicated above, due to the increased compression and weight of the tow within the high density bale, the bale bottom presents an increased flatter surface as well as a harder surface to the floor. The pads extend from the bottom of the bale enabling the unrelieved areas and the strappings on the bottom of the bale to be essentially out of contact with the floor.

Figure 2:
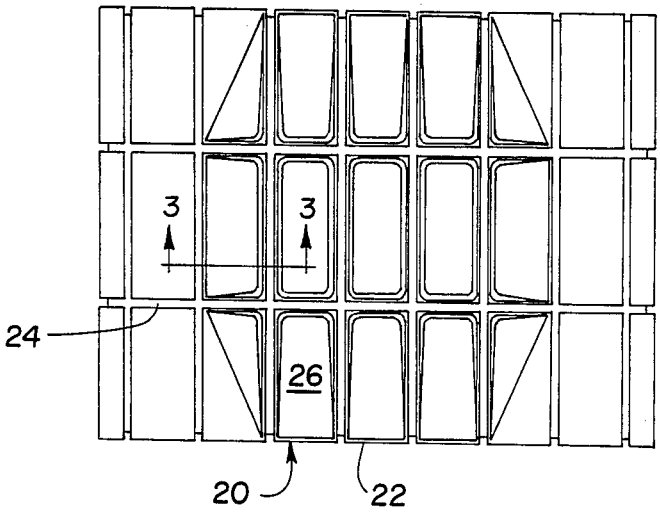
FIG. 2 is a plan view of a tow baler platen illustrating areas recessed in the faces of some of the sections of the platen and slots between the sections for the receipt of the tow bale strappings (not shown) prior to release of the tow bale from compression and from a tow baler (not shown)
Figure 3:
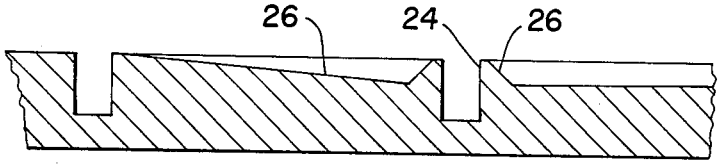
FIG. 3 is a view taken along line 3—3 in FIG. 2.

Although I could add individual pads to the bale bottom covering and suitably secure them thereto at intervals sufficiently spaced to enable the metal strappings to be located in the spaces between the added pads, I prefer to form the multiple pads 16 as an integral part of the bale bottom, which formation can be accomplished more efficiently and economically as will be appreciated from the discussion to follow. The bottom of a tow baler (not shown) is called a "platen" and I proposed to divide the platen, which is shown in FIG. 2 at 20, into a number of separate sections 22 which extend across the face of the platen and which are spaced with respect to each other so as to form therebetween slots 24 of predetermined width and depth. The slots enable an operator to insert strappings therealong while the tow bale is held under compression in the tow baler. This part of the operation of a tow baler is well known in the industry. Each section of a predetermined number of the separate sections, as shown in FIG. 2, defines within its face a recessed surface 26. The depth of the recess is determined by how much the bale covering is capable of stretching without the bale covering becoming torn or broken when the filamentary tow and bale covering are pressed into the recess as the filamentary tow is being baled. Since the peripheral edges of the bale bottom will curve away from the floor when the tow bale is seated thereon, it is only necessary to form the recesses in a predetermined number of the separate sections 22 which is more toward the center of the bale bottom. In this latter connection, it should be understood that the pads shown in profile in FIG. 1 have been exaggerated for purposes of illustration. The peripheral edges of the bottom of the bale will generally not make contact with the floor when the bale is seated thereon. FIG. 3, for example, shows how the left-most section, which is near the outer periphery of the bale bottom, is tapered to form a partial recess while the section to the right of that one is shown to be fully recessed. As should now be evident, these recesses will enable the bottom covering and the filamentary tow adjacent to the bottom covering to bulge into or be embossed into the recesses as the filamentary tow is being compressed by the tow baler. In this manner, the resulting formed multiple pads 16 provide protective areas for the adjacent unrelieved areas 18 where the strappings will pass along the bottom of the bale. As a consequence only the pads will contact the floor and the strappings may be readily slidably removed from the bale bottom.

The invention has been described in detail with particular reference to preferred embodiments thereof, but it will be understood that variations and modifications can be effected within the spirit and scope of the invention.

I claim:

1. A bale in which filamentary tow such as filter tow has been compressed by a tow baler and wrapped with a cardboard or the like covering and held in compressed condition by multiple strappings which extend around the wrapped bale in different directions at right angles with respect to each other; said bale characterized by its bottom and the filamentary tow that is adjacent the covering at the bottom of the bale having embossed therein a pattern of multiple pads and unrelieved areas between the pads, said unrelieved areas adapted to receive said strappings and said pads adapted to make contact with the floor while the bale is seated thereon for opening and thereby enable the strappings to be readily slidably removed from the bottom of the bale.

2. In a bale in which filamentary tow such as filter tow has been compressed by a tow baler and wrapped with a cardboard or the like covering and held in compressed condition by multiple strappings which extend around the wrapped bale in different directions at right angles with respect to each other, the method of forming by embossing on both the bottom of the bale and the filamentary tow that is adjacent the covering at the bottom of the bale a pattern of multiple pads and unrelieved areas between the pads as the filamentary tow is being compressed by said tow baler, said unrelieved areas adapted to receive said strappings and said pads adapted to make contact with the floor while the bale is seated thereon for opening and thereby enable the strappings to be readily slidably removed from the bottom of the bale.

3. The method as defined in claim 2 wherein said multiple pads are embossed by the platen of said tow baler as the filamentary tow is being compressed by said tow baler.

4. The method as defined in claim 2 wherein the platen of said tow baler comprises a number of separate sections extending across the face of the platen and slots of predetermined width and depth between said sections, each section of a predetermined number of said separate sections defining within its face a recessed surface, said method including the step of pressing the filamentary tow adjacent the bottom covering of the bale and said bottom covering into each of the recessed surfaces to form by embossing said pattern of multiple pads and unrelieved areas between said pads as said filamentary tow is being compressed by said tow baler.

* * * * *